US010689933B2

(12) United States Patent
Deul et al.

(10) Patent No.: US 10,689,933 B2
(45) Date of Patent: Jun. 23, 2020

(54) PRESSURE ASSISTED MOTOR OPERATED RAM ACTUATOR FOR WELL PRESSURE CONTROL DEVICE

(71) Applicant: Noble Drilling Services Inc., Sugar Land, TX (US)

(72) Inventors: Hans H. J. Deul, Richmond, TX (US); Patrick O'Neill, Houston, TX (US); Matthew Sibrel, Missouri City, TX (US); Robert van Kuilenburg, Sugar Land, TX (US); Ivan Iankov, Houston, TX (US)

(73) Assignee: Noble Drilling Services Inc., Sugar Land, TX (US)

( * ) Notice: Subject to any disclaimer, the term of this patent is extended or adjusted under 35 U.S.C. 154(b) by 0 days.

(21) Appl. No.: 16/028,141

(22) Filed: Jul. 5, 2018

(65) Prior Publication Data

US 2019/0003275 A1 Jan. 3, 2019

Related U.S. Application Data

(63) Continuation of application No. PCT/US2016/069256, filed on Dec. 29, 2016.

(60) Provisional application No. 62/274,829, filed on Jan. 5, 2016.

(51) Int. Cl.
*E21B 33/035* (2006.01)
*E21B 33/06* (2006.01)

(52) U.S. Cl.
CPC ..... *E21B 33/0355* (2013.01); *E21B 33/062* (2013.01); *E21B 33/063* (2013.01)

(58) Field of Classification Search
CPC ..... E21B 33/0355; E21B 33/06–064
See application file for complete search history.

(56) References Cited

U.S. PATENT DOCUMENTS 1,858,352 A * 5/1932 Young ..... E21B 33/061 251/1.1
2,035,319 A 3/1936 Hughes
2,877,977 A 3/1959 Allen
3,027,703 A * 4/1962 Royle ..... B23Q 5/36 318/162

(Continued)

FOREIGN PATENT DOCUMENTS

CN 103429911 A 12/2013
RU 2370627 C2 10/2009

(Continued)

OTHER PUBLICATIONS

International Search Report and Written Opinion, International Application No. PCT/US2016/069256 dated Apr. 28, 2017.

(Continued)

*Primary Examiner* — James G Sayre
*Assistant Examiner* — Aaron L Lembo
(74) *Attorney, Agent, or Firm* — Richard A. Fagin

(57) ABSTRACT

An apparatus for actuating a ram in a well pressure control apparatus includes an actuator rod coupled to a ram. The actuator rod is movable within a housing to extend the ram into a through bore in the housing. A drive screw is rotationally coupled to the actuator rod. The drive screw is oriented transversely to the actuator rod. At least one motor is rotationally coupled to the drive screw.

16 Claims, 3 Drawing Sheets

(56) References Cited

U.S. PATENT DOCUMENTS

| | | | | |
|---|---|---|---|---|
| 3,215,393 | A * | 11/1965 | Herbert | E21B 33/062 251/1.3 |
| 3,250,336 | A * | 5/1966 | Haeber | E21B 33/0355 166/352 |
| 3,319,923 | A * | 5/1967 | Haeber | E21B 33/0355 251/1.3 |
| 3,324,875 | A * | 6/1967 | Anderson | E21B 33/0375 137/236.1 |
| 4,026,354 | A * | 5/1977 | Burrow | E21B 33/03 166/95.1 |
| 4,095,421 | A * | 6/1978 | Silcox | E21B 33/0355 137/236.1 |
| 4,435,988 | A | 3/1984 | Corry et al. | |
| 4,582,293 | A | 4/1986 | Jones | |
| 4,927,112 | A | 5/1990 | Wilson | |
| 5,505,426 | A * | 4/1996 | Whitby | E21B 33/062 251/1.1 |
| 5,653,418 | A * | 8/1997 | Olson | E21B 29/08 251/1.3 |
| 5,978,739 | A | 11/1999 | Stickton | |
| 6,554,247 | B2 | 4/2003 | Berckenhoff et al. | |
| 7,025,322 | B2 | 4/2006 | Biester | |
| 7,190,096 | B2 | 3/2007 | Blanding et al. | |
| 7,926,501 | B2 * | 4/2011 | Springett | E21B 33/0355 137/14 |
| 8,181,931 | B2 * | 5/2012 | Jennings | E21B 34/04 251/62 |
| 8,220,773 | B2 | 7/2012 | Gustafson | |
| 8,387,706 | B2 * | 3/2013 | Baugh | E21B 33/038 166/339 |
| 8,657,253 | B2 | 2/2014 | Judge et al. | |
| 9,121,268 | B2 * | 9/2015 | Minnock | E21B 17/028 |
| 9,163,471 | B2 | 10/2015 | Coonrod et al. | |
| 9,506,543 | B2 * | 11/2016 | Naubert | F16H 25/2025 |
| 9,863,206 | B2 * | 1/2018 | Biester | E21B 33/0355 |
| 2004/0031940 | A1 | 2/2004 | Biester et al. | |
| 2006/0144622 | A1 | 7/2006 | Bailey et al. | |
| 2008/0105434 | A1 | 5/2008 | Orbell et al. | |
| 2010/0155071 | A1 * | 6/2010 | Gustafson | E21B 33/0355 166/335 |
| 2013/0283919 | A1 | 10/2013 | Coonrod et al. | |
| 2014/0262205 | A1 * | 9/2014 | Baker | E21B 33/085 166/85.4 |
| 2015/0034298 | A1 * | 2/2015 | Read | E21B 33/063 166/86.3 |
| 2016/0084031 | A1 * | 3/2016 | DeOcampo | E21B 33/062 166/373 |
| 2016/0348459 | A1 * | 12/2016 | Jaffrey | E21B 33/06 |

FOREIGN PATENT DOCUMENTS

| | | | |
|---|---|---|---|
| SU | 1694853 | A1 | 11/1991 |
| WO | 2008088226 | A1 | 7/2008 |

OTHER PUBLICATIONS

European Extended Search Report, EP application No. 16884225.0-1002 dated Feb. 1, 2019.

Search Report, Russian Patent Application No. 2018128052/03 dated May 16, 2019.

Granting Decision of the Russian Patent Office, Russian Patent Application No. 2018128052/03 dated May 16, 2019, original in Russian.

Granting Decision of the Russian Patent Office, Russian Patent Application No. 2018128052/03 dated May 16, 2019, English translation.

Australian Examination Report, Application No. 2015390010, dated Jul. 28, 2018.

Chinese Office Action dated Nov. 26, 2019, Application No. 201680082514.3.

Partial translation of Chinese Office Action dated Nov. 26, 2019, Application No. 201680082514.3.

* cited by examiner

PRESSURE ASSISTED MOTOR OPERATED RAM ACTUATOR FOR WELL PRESSURE CONTROL DEVICE

CROSS REFERENCE TO RELATED APPLICATIONS

Continuation of International Application No. PCT/US2016/069256 filed on Dec. 29, 2016. Priority is claimed from U.S. Provisional Application No. 62/274,829 filed on Jan. 5, 2016. Each of the foregoing applications is incorporated herein by reference in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

This disclosure relates generally to the field of drilling wells through subsurface formations. More specifically, the disclosure relates to apparatus for controlling release of fluids from such wellbores, such devices called blowout preventers (BOPs).

BOPs known in the art have one or more sets of opposed "rams" that are urged inwardly into a housing coupled to a wellhead in order to hydraulically close a wellbore under certain conditions or during certain wellbore construction operations. The housing may be sealingly coupled to a wellhead or casing flange at the top of the well. The rams, when urged inwardly, may either seal against a pipe string passing through the BOP and/or seal against each other when there is no pipe (or when the pipe is present but must be cut or "sheared." Movement of the rams is performed by hydraulically operated actuators.

BOPs known in the art used in marine operations may be coupled to a wellhead at the bottom of a body of water such as a lake or the ocean. In such BOPs, electrical power may be supplied from a drilling unit above the water surface, which may be converted to hydraulic power by a motor operated pump proximate the BOP. There may also be hydraulic oil tanks having hydraulic fluid under pressure proximate the BOP in order to provide the necessary hydraulic pressure to close the rams in the event of failure of the hydraulic pump or drive motor.

A typical hydraulically actuated BOP is described in U.S. Pat. No. 6,554,247 issued to Berkenhof et al.

SUMMARY

An apparatus for actuating a ram in a well pressure control apparatus according to one aspect of the disclosure includes an actuator rod coupled to a ram, the actuator rod movable within a housing to extend the ram into a through bore in the housing. A drive screw is rotationally coupled to the actuator rod, the drive screw oriented transversely to the actuator rod. At least one motor is rotationally coupled to the drive screw.

Some embodiments further comprise a piston disposed at a longitudinal end of the actuator rod opposite to the ram, the piston exposed to a source of fluid pressure on a side of the piston opposite to the actuator rod.

In some embodiments the source of fluid pressure comprises hydraulic fluid pressure.

In some embodiments, the source of fluid pressure comprises pneumatic pressure.

In some embodiments, the source of fluid pressure comprises ambient water pressure at the bottom of a body of water.

In some embodiments, at least a portion of a side of the piston opposite to the source of fluid pressure is exposed to vacuum.

In some embodiments, the actuator rod comprises a jack screw.

In some embodiments, the jack screw is in rotational contact with the drive screw through a recirculating ball nut.

In some embodiments, the at least one motor comprises an electric motor.

In some embodiments, the at least one motor comprises an hydraulic motor.

In some embodiments, the at least one motor comprises a pneumatic motor.

Some embodiments further comprise a pressure sensor arranged to measure a longitudinal force applied to the actuator rod.

Some embodiments further comprise a linear position sensor arranged to measure a longitudinal position of the actuator rod.

Some embodiments further comprise a controller in signal communication with the longitudinal position sensor and having a control output in signal communication with the at least one motor, the controller configured to operate the motor to automatically fully open the ram or to automatically fully close the ram based on measurements from the linear position sensor.

In some embodiments, the at least one motor comprises a drive feature to enable rotation of the motor by an external drive device.

In some embodiments, the external drive device comprises a remotely operated vehicle.

Some embodiments further comprise a torque arrestor functionally coupled between the actuator rod and the housing.

Some embodiments further comprise a piston disposed at a longitudinal end of the actuator rod opposite to the ram, the piston exposed to a source of fluid pressure on a side of the piston opposite to the actuator rod, and further comprising a torque arrestor coupled between the piston and the housing.

DETAILED DESCRIPTION

Figure 1:
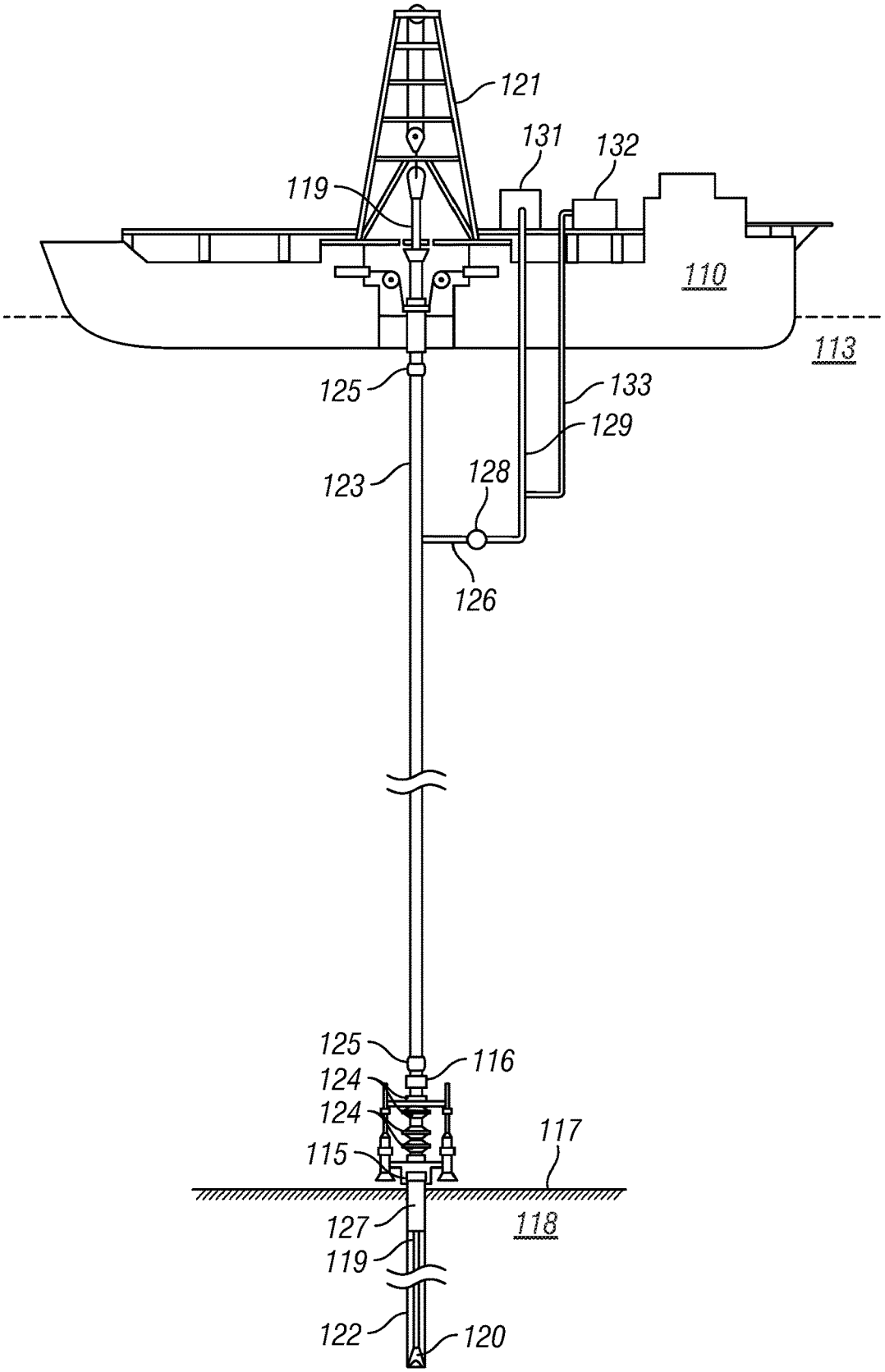
FIG. 1 shows an example of marine drilling a well from a floating drilling platform wherein a blowout preventer is installed on the wellhead.

FIG. 1 is provided to show an example embodiment of well drilling that may use well pressure control apparatus according to various aspects of the present disclosure. FIG. 1 shows a drilling vessel 110 floating on a body of water 113 and equipped with apparatus according to the present disclosure. A wellhead 115 is positioned proximate the sea floor 117 which defines the upper surface or "mudline" of subbottom formations 118. A drill string 119 and associated drill bit 120 are suspended from derrick 121 mounted on the vessel and extends to the bottom of wellbore 122. A length of structural casing 127 extends from the wellhead 115 to a selected depth into the bottom sediments above the wellbore 122. Concentrically receiving drill string 119 is a riser 123 which is positioned between the upper end of blowout preventer stack 124 and vessel 110. Located at each end of riser 123 are ball joints 125.

Positioned near the upper portions of riser pipe 123 is lateral outlet 126 which connects the riser pipe to flow line 129. Outlet 126 is provided with a throttle valve 28. Flow line 129 extends upwardly to separator 131 aboard the vessel 110, thus providing fluid communication from riser pipe 123 through flow line 129 to the vessel 110. Also aboard the drilling vessel is a compressor 132 for feeding pressurized gas into gas injection line 133 which extends downwardly from the drilling vessel and into the lower end of flow line 129. The foregoing components may be used in so-called "dual gradient" drilling, wherein modification and/or pumping the returning drilling fluid to the vessel 110 may provide a lower hydrostatic fluid pressure gradient in the riser 123 than would be the case if the drilling fluid were not so modified or pumped as it returns to the vessel 110. For purposes of defining the scope of the present disclosure, such fluid pressure gradient modification need not be used in some embodiments. The example embodiment disclosed herein is intended to serve only as an example and is not in any way intended to limit the scope of the present disclosure.

In order to control the hydrostatic pressure of the drilling fluid within riser pipe 123, in some embodiments drilling fluids may be returned to the vessel 110 by means of the flow line 129. As with normal offshore drilling operations, drilling fluids are circulated down through drill string 119 to drill bit 210. The drilling fluids exit the drill bit and return to the riser 123 through the annulus defined by drill string 119 and wellbore 122. A departure from normal drilling operations then occurs. Rather than return the drilling fluid and drilled cuttings through the riser pipe to the drilling vessel, the drilling fluid is maintained at a level which is somewhere between upper ball joint 125 and outlet 126. This fluid level is related to the desired hydrostatic pressure of the drilling fluid in the riser pipe which will not fracture sedimentary formation 118, yet which will maintain well control.

In such embodiments, drilling fluid may be withdrawn from riser 123 through lateral outlet 126 and is returned to the vessel 110 through flow line 129. Throttle valve 128 which controls the rate of fluid withdrawal from the riser pipe, feeds the drilling fluid into flow line 129. Pressurized gas from compressor 132 is transported down gas injection line 133 and injected into the lower end of flow line 129. The injected gas mixes with the drilling fluid to form a lightened three phase fluid consisting of gas, drilling fluid and drill cuttings. The gasified fluid has a density substantially less than the original drilling fluid and has sufficient "lift" to flow to the surface.

Figure 2:
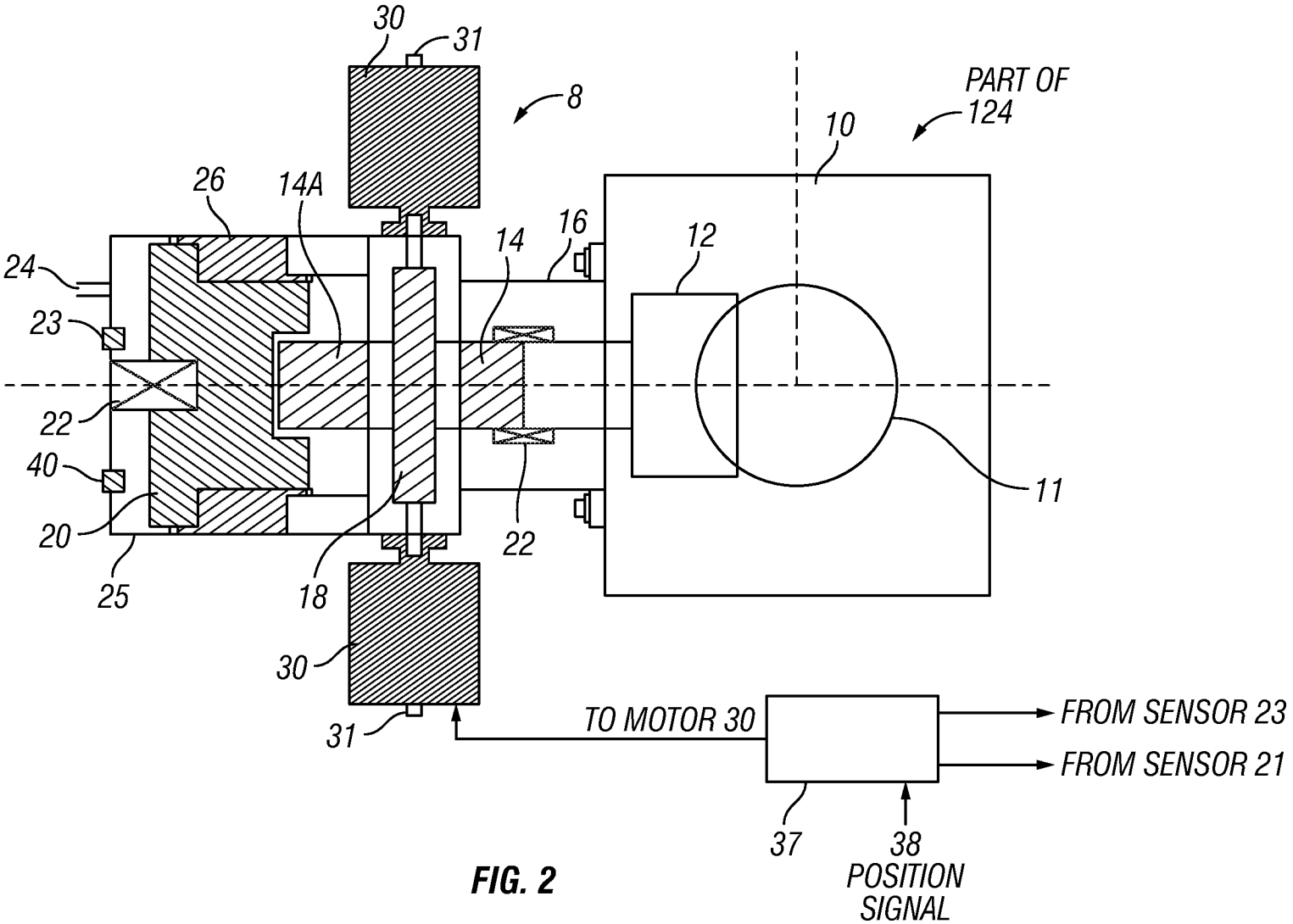
FIG. 2 shows a side view of an example embodiment of a well pressure control apparatus according to the present disclosure.
Figure 3:
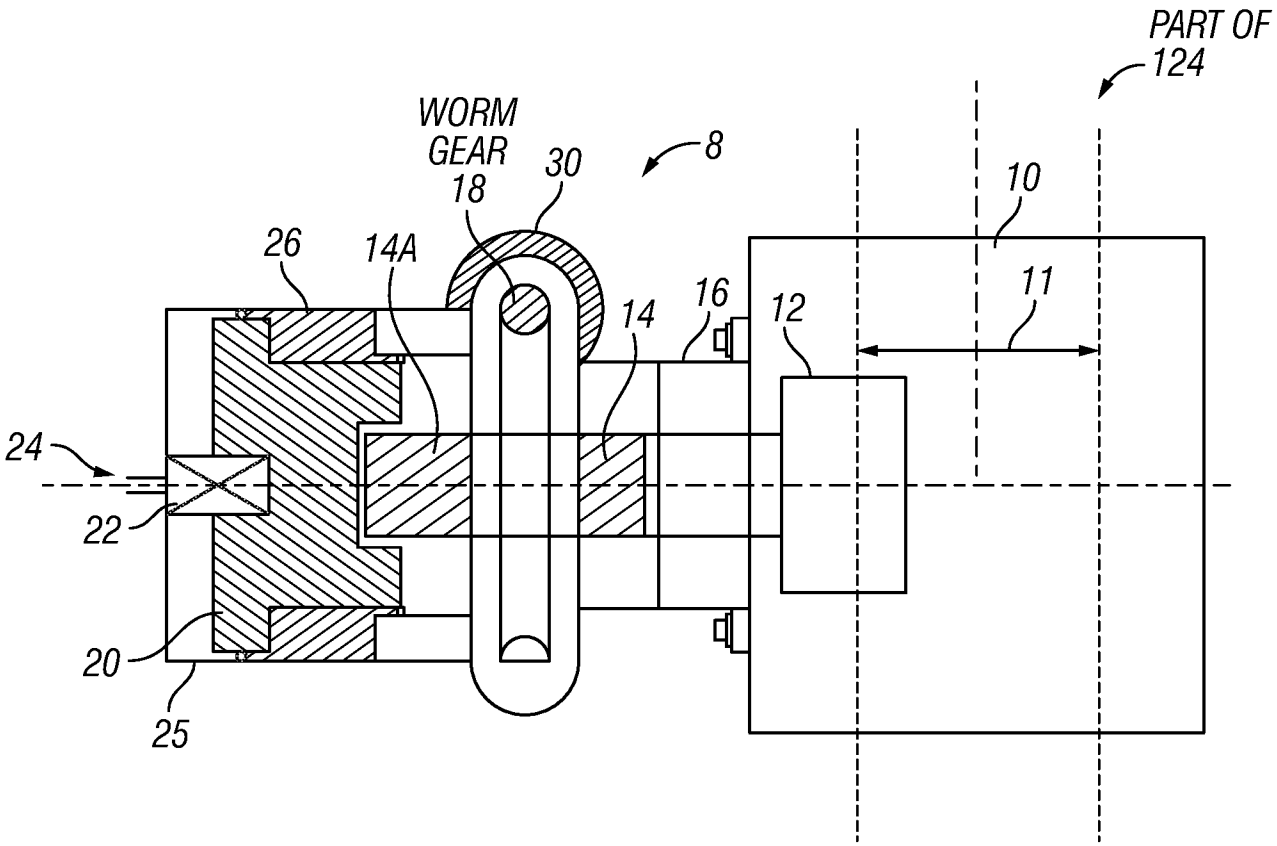
FIG. 3 shows a top view of the example embodiment of an apparatus as in FIG. 1.

FIG. 2 shows a side elevation view and FIG. 3 shows a top view of an example well pressure control apparatus 8 according to various aspects of the present disclosure. The well pressure control apparatus may be a blowout preventer (BOP) which includes a housing 10 having a through bore 11 for passage of well tubular components used in the drilling and completion of a subsurface wellbore. For clarity of the illustration, functional components of the BOP are shown on only one side of the housing 10. It will be appreciated that some example embodiments of a BOP may include substantially identical functional components coupled to the housing 10 diametrically opposed to those shown in FIG. 2 and FIG. 3.

The through bore 11 may be closed to passage of fluid by inward movement of a ram 12 into the through bore 11. In some embodiments which include functional components on only one side of the housing 10, the ram, when fully extended into the through bore 11 may fully close and seal the through bore 11 as in the manner of a gate valve. In other embodiments of a BOP in which substantially identical components are disposed on opposed sides of the housing 10, the ram 12 may when fully extended contact an opposed ram (not shown in the Figures) that enters the through bore 11 from the other side of the housing 10. In the present example embodiment, the ram 12 may be a so called "blind" ram, which sealing closes the through bore 11 to fluid flow when no wellbore tubular device is present in the through bore 11. In some embodiments, the ram may be a so called "shear" ram that may be operated to sever a wellbore tubular disposed in the through bore 11 so that the BOP may be sealingly closed in an emergency when removal of the tubular is not practical. In other embodiments, the ram 12 may be a "pipe" ram that is configured to sealingly engage the exterior surface of a wellbore tubular, e.g., a segment of drill pipe, so that the wellbore may be closed to escape of fluid when the tubular is disposed in the through bore without the need to sever the tubular.

The ram 12 may be coupled to a ram shaft 14. The ram shaft 14 moves longitudinally toward the through bore 11 to close the ram 12, and moves longitudinally away from the through bore to open the ram 12. The ram shaft 14 may be sealingly, slidably engaged with the housing 10 so that a compartment usually referred to as a "bonnet" 16 may be maintained at surface atmospheric pressure and/or exclude entry of fluid under pressure such as ambient sea water pressure when the well pressure control apparatus 8 is disposed on the bottom of a body of water in marine drilling operations.

The ram shaft 14 may be coupled to an actuator rod 14A. In the present embodiment, the actuator rod 14A may be a jack screw, which may be in the form of a cylinder with helical threads formed on an exterior surface thereof. In the present example embodiment, the actuator rod 14A may include a recirculating ball nut (not shown for clarity in the Figures) engaged with the threads of the actuator rod 14A. A worm gear 18 may be placed in rotational contact with the ball nut, if used, or with the actuator rod 14A. In some embodiments, other versions of a planetary roller type may be used to link the actuator rod 14A to the worm gear 18. Rotation of the worm gear 18 will cause inward or outward movement of the actuator rod 14A, and corresponding movement the ram shaft 14 and ram 12.

The worm gear may be rotated by at least one, and in the present embodiment, an opposed pair of motors 30. The motor(s) 30 may be, for example, electric motors, hydraulic motors or pneumatic motors.

An outward longitudinal end of the actuator rod 14A may be in contact with a torque arrestor 22. The torque arrestor 22 may be any device which rotationally locks the actuator rod 14A to a piston 20 on the other side of the torque arrestor 22. The piston 20 may be disposed in a cylinder 25 that is hydraulically isolated from the bonnet 16. One side of the piston 20 may be exposed to an external source of pressure 24, for example and without limitation, hydraulic pressure from an accumulator or pressure bottle, pressurized gas, or ambient sea water pressure when the pressure control apparatus 8 is disposed on the bottom of a body of water. The other side of the piston 20 may be exposed to reduced pressure 26, e.g., vacuum or atmospheric pressure such that inward movement of the piston 20 is substantially unimpeded by compression of gas or liquid in such portion of the cylinder 25. The other side of the piston 20 may be in contact with another torque arrestor 22. The other torque arrestor 22 may be fixedly mounted to the cylinder 25.

In the present example embodiment, a pressure sensor 21 may be mounted between the piston 20 and the torque arrestor 22. The pressure sensor 21 may be, for example a piezoelectric element disposed between two thrust washers. The pressure sensor 21 may generate a signal corresponding to the amount of force exerted by the piston and the actuator rod 14A against the ram 12 to open or close the ram 12. Another pressure sensor 40 may be used as shown in FIG. 2. In some embodiments, a longitudinal position of the actuator rod 14A or piston 20 may be measured by a linear position sensor 23, for example a linear variable differential transformer or by a helical groove formed in the exterior surface of the piston 20 and a variable reluctance effect sensor coil (not shown).

As may be observed in FIG. 2, the motor(s) 30 may have a manual operating feature 31, such as a hex key or other torque transmitting feature to enable rotation of the worm gear 16 in the event of motor failure. The torque transmitting feature 31 may be rotated by a motor, e.g., on a remotely operated vehicle (ROV) should such operation become necessary.

Referring specifically to FIG. 2, in some embodiments, the well pressure control apparatus 8 may be made to operate in "closed loop" mode, whereby an instruction may be sent to the apparatus 8 to open the ram 12 or to close the ram. For such purpose a controller 37, which may be any form of microcontroller, programmable logic controller or similar process control device, may be in signal communication with the pressure sensor 21 and the linear position sensor 23. A control output from the controller 37 may be functionally coupled to the motor(s) 30. When a command is received by the controller 37 to close the ram 12, the controller 37 will operate the motor(s) 30 to rotate the worm gear 16 and cause the actuator rod 14A to move the ram 12 toward the through bore. Fluid pressure acting on the other side of the piston 20 will increase the amount of force exerted by the actuator rod 14A substantially above the force that would be exerted by rotation of the motor(s) 30 alone. When pressure measured by the pressure sensor 21 increases, and when the linear position sensor 23 measurement indicates the ram 12 is fully extended into the through bore 11, the controller 37 may stop rotation of the motor(s) 30. The reverse process may be used to open the ram 12 and stop rotation of the motor(s) 30 when the sensor measurements indicate the ram 12 is fully opened. In such manner, opening and closing the ram 12 may be performed without the need for the user to monitor any measurements and manually operate controls; the opening and closing of the ram 12 may be fully automated after communication of an open or close command to the controller 37.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for actuating a ram in a well pressure control apparatus, comprising:

an actuator rod coupled to the ram, the actuator rod movable within a housing to extend the ram into a through bore in the housing;

a piston disposed at a longitudinal end of the actuator rod opposite to the ram, the piston exposed to a source of fluid pressure on a side of the piston opposite to the actuator rod;

a drive screw rotationally engaged with the actuator rod between the piston and the ram, the drive screw oriented transversely to the actuator rod; and at least one motor rotationally coupled to the drive screw.

2. The apparatus of claim 1 wherein the source of fluid pressure comprises hydraulic fluid pressure.

3. The apparatus of claim 1 wherein the source of fluid pressure comprises pneumatic pressure.

4. The apparatus of claim 1 wherein the source of fluid pressure comprises ambient water pressure at the bottom of a body of water.

5. The apparatus of claim 1 wherein at least a portion of a side of the piston opposite to the source of fluid pressure is exposed to vacuum.

6. The apparatus of claim 1 wherein the actuator rod comprises a jack screw.

7. The apparatus of claim 6 wherein the jack screw is in rotational contact with the drive screw through a recirculating ball nut.

8. The apparatus of claim 1 wherein the at least one motor comprises an electric motor.

9. The apparatus of claim 1 wherein the at least one motor comprises an hydraulic motor.

10. The apparatus of claim 1 wherein the at least one motor comprises a pneumatic motor.

11. The apparatus of claim 1 further comprising a pressure sensor arranged to measure a longitudinal force applied to the actuator rod.

12. The apparatus of claim 1 further comprising a linear position sensor arranged to measure a longitudinal position of the actuator rod.

13. The apparatus of claim 12 further comprising a controller in signal communication with the longitudinal position sensor and having a control output in signal communication with the at least one motor, the controller configured to operate the motor to automatically fully open the ram or to automatically fully close the ram based on measurements from the linear position sensor.

14. The apparatus of claim 1 wherein the at least one motor comprises a drive feature to enable rotation of the motor by an external drive device.

15. The apparatus of claim 14 wherein the external drive device comprises a remotely operated vehicle.

16. The apparatus of claim 1 further comprising a torque arrestor rotationally locking the actuator rod to at least one of the piston and the housing.

* * * * *